US010350507B2

(12) United States Patent
Yang

(10) Patent No.: US 10,350,507 B2
(45) Date of Patent: Jul. 16, 2019

(54) BUBBLE MACHINE

(71) Applicant: 1byone Products Inc., Ontario, CA (US)

(72) Inventor: Ruishi Yang, Ontario, CA (US)

(73) Assignee: Shenzhen 1Byone Technology Co., Ltd., Shenzhen, Guangdon Province (CN)

( * ) Notice: Subject to any disclaimer, the term of this patent is extended or adjusted under 35 U.S.C. 154(b) by 0 days.

(21) Appl. No.: 15/794,914

(22) Filed: Oct. 26, 2017

(65) Prior Publication Data

US 2019/0126161 A1 May 2, 2019

(51) Int. Cl.
*A63H 33/28* (2006.01)
*A63J 5/02* (2006.01)

(52) U.S. Cl.
CPC ..... *A63H 33/28* (2013.01); *A63J 5/02* (2013.01)

(58) Field of Classification Search
CPC ..... A63H 33/28
See application file for complete search history.

(56) References Cited

U.S. PATENT DOCUMENTS 2,452,794 A * 11/1948 Saachy ..... A63H 33/28 40/408
2,813,361 A * 11/1957 Consolo ..... A63H 33/28 40/408
5,879,218 A * 3/1999 Tao ..... A63H 33/28 446/15
7,172,484 B2 * 2/2007 Thai ..... A63H 33/28 446/15
2012/0220184 A1 * 8/2012 Orem ..... A63H 33/28 446/16

* cited by examiner

*Primary Examiner* — Eugene L Kim
*Assistant Examiner* — Alyssa M Hylinski
(74) *Attorney, Agent, or Firm* — Muncy, Geissler, Olds & Lowe, P.C.

(57) ABSTRACT

The present invention relates to the field of toys or stage equipments, and provides a bubble machine comprising a housing; a liquid storage device provided at front of the housing for containing a bubble liquid; a chamber provided at rear of the liquid storage device, comprising an air inlet and a first air outlet; a film forming device provided above the liquid storage device, wherein the film forming device comprises a rotation center, a film forming unit connected with the rotation center, and a motor for driving rotation of the film forming unit about the rotation center, wherein the motor drives the film forming unit to rotate to successively pass the bubble liquid in the liquid storage device and the first air outlet; a blowing device provided in the housing for providing air flow from the air inlet to the first air outlet; and a control device provided at top of the housing for controlling the film forming device and the blowing device. Bubbles can be produced constantly and automatically by cooperation of the above components. The present invention provides a simple structure that is easy to use and requires no man power to produce bubbles. The control device is provided at top of the housing, facilitating control of operation of the bubble machine by a user.

8 Claims, 5 Drawing Sheets

BUBBLE MACHINE

FIELD OF THE INVENTION

The present invention relates to the field of toys or stage equipments, and in particular to a bubble machine.

BACKGROUND OF THE INVENTION

A bubble machine is a machine used for producing bubbles, whose design concept is derived from traditional bubble games. It not only can act as a toy for people to play, but also can act as an equipment for creating effects and atmosphere on a stage. Traditional bubble games normally use a tool comprising a ring to dip into a soap liquid, which forms a film on the ring from which a single or a series of bubbles will be produced when blowing towards the ring. Refraction on top and bottom of the film of the bubble created by light passing through the film will make the bubble reflect different colors. This makes bubble games a lot of children's favorite. Creating bubbles is also a way to create effects and atmosphere on many stages. Although blowing can create bubbles, longtime blowing will lead to pain in the face. In addition, this way can only produce a low amount of bubbles with a short floating distance and poor continuity.

Conventional bubble machine generally comprises a film forming unit, a liquid storage device and a blowing device, wherein the film forming unit constantly switches and circulates between forming liquid film and forming bubbles, such that bubbles can be created automatically. However, mounting position of the liquid storage device is constrained due to universal gravitation, and therefore in a conventional bubble machine, bubbles can generally be blew to a distance only by the blowing device, in which case the bubbles can only constantly go down when flying to a distance due to its own gravity. In addition, the blowing device can blow the bubbles to a distance only in one direction, which leads to a poor diffusion and thus a short remaining time of the bubbles.

Since the film forming device is required to switch between forming liquid film by dipping soap liquid and forming bubbles by air flow, it is required to be exposed to the environment. In this case, when the bubble machine is working, the soap liquid to form bubbles will make the environment around the bubble machine be filled with gaseous water molecules, and the motor in the film forming device driving its rotation will be shortened in its life due to long time exposure to the gaseous water molecules.

SUMMARY OF THE INVENTION

In view of the above, an object of the present invention is to overcome at least one of the above deficiencies in the art, and provide a bubble machine that can continuously produce bubbles with a broad diffusion range and a long remaining time.

This and other objects and advantages of the present invention are achieved by the solutions described herein after.

A bubble machine is provided comprising a housing; a liquid storage device provided at front of the housing for containing a bubble liquid; a chamber provided at rear of the liquid storage device, comprising an air inlet and a first air outlet; a film forming device provided above the liquid storage device, wherein the film forming device comprises a rotation center, a film forming unit connected with the rotation center, and a motor for driving rotation of the film forming unit about the rotation center, wherein the motor drives the film forming unit to rotate to successively pass the bubble liquid in the liquid storage device and the first air outlet; a blowing device provided in the housing for providing air flow from the air inlet to the first air outlet; and a control device provided at top of the housing for controlling the film forming device and the blowing device.

In the present invention, the liquid storage device, the chamber, the film forming device, the blowing device and the control device are all installed inside the housing of the bubble machine, and bubbles can be produced constantly and automatically by cooperation of the above components. The present invention provides a simple structure that is easy to use and requires no man power to produce bubbles. The control device is provided at top of the housing, facilitating control of operation of the bubble machine by a user.

In order to allow liquid film on the film forming unit successfully form bubbles with the aid of air flow, a first air-flow flowing out of the first air outlet is required to be substantially perpendicular to the surface of the film forming unit, otherwise it is easy to break the liquid film and hard to form bubbles, reducing bubble producing rate. However, this also makes the first air-flow only capable of pushing formed bubbles far away, but not pushing bubbles to fly upward. In view of this, a second air outlet is provided between the first air outlet and the rotation center, the second air outlet is inclining upward and connected with the chamber. A second air-flow flowing out of the second air outlet will flow inclining upward along the second air outlet, and provide bubbles just formed by the film forming device with an up going force to make the bubbles fly upward, such that the bubbles can stay in the air for a longer time, increasing remaining time of the bubbles.

In order to provide a bubble machine with a compact structure, the blowing device is generally in a coaxial arrangement with the film forming device. In order to make air-flow in the lower portion go upward, an inclining blowing surface is formed at a front end of the chamber, the first air outlet is formed between an upper edge of the blowing surface and the housing, and the second air outlet is formed below the upper edge of the blowing surface. After coming into contact with the blowing surface, the air flow produced by the blowing device will flow upward along the blowing surface under pushing of subsequent air flow, and finally flow out of the second air outlet or the first air outlet.

Since the blowing surface is in an inclined arrangement, in order to prevent part of the air flow that is going upward along the blowing surface directly flowing out of the first air outlet in an inclined upward direction and thereby forming disturbance to the first air-flow and increasing difficulty of forming bubbles, the blowing surface is provided with a first blocking plate at the upper edge at the first air outlet. After coming into contact with the first blocking plate, the part of air flow that is going upward along the blowing surface will flow upward along the first blocking plate under pushing of other horizontal air flow, whose flow-rate will be greatly decreased after changing direction due to contact with the wall, thereby reducing influence on direction of the first air-flow and thus reducing influence on bubble producing.

The blowing surface is provided with a first inclining surface and a second inclining surface below the second air outlet, and a obtuse angle is formed by the first inclining surface and the second inclining surface. On one hand, the first inclining surface and the second inclining surface provide guidance to direction of the air flow. The air flow formed by the blowing device flows parallel to the horizontal plane, and then changes direction after coming into contact with the first inclining surface or the second inclining surface, and at the same time it is pushed by other horizontal air flow constantly coming from the blowing device. This makes the air flow hit the wall and then climb up along the first inclining surface or the second inclining surface toward the second air outlet, and finally most of the climbing up air flow flows out of the second air outlet in a predesigned angle, thus forming the second air-flow to push bubbles to fly upward. On the other hand, switching between forming liquid film and forming bubbles of the film forming unit will make its surrounding environment filled with gaseous water molecules. The motor that drives rotation of the film forming unit is located closest to where gaseous water molecules are formed, and therefore is easiest to fail due to moisture. The first inclining surface and the second inclining surface allow more enclosed space formed between the chamber and the housing for receiving the motor that drives rotation of the film forming unit. Even all the above circuit elements can be received in the enclosed space formed between the chamber and the housing. This ensures these elements always in a dry state, increasing life of the bubble machine.

In order to distribute more air flow formed by the blowing device to the first air outlet to form bubbles, the first inclining surface and the second inclining surface are both located in middle of the blowing surface, two side of which forms an inclining blowing passage. Air flow at two sides of the chamber climbs up along the inclining blowing passage, and due to inertia effect, most of the air flow will cross the second air outlet and flow out of the first air outlet, allowing more air flow formed by the blowing device be used for forming bubbles.

In order to reduce the flow caught by the second air outlet in the chamber, a transverse size of the second air outlet is smaller than a transverse size of the first air outlet, so as to ensure that a considerable proportion of the air flow formed by the blowing device is used for forming bubbles.

Two sides of the first air outlet are defined respectively as a rotate-in side and a rotate-out side according to rotation direction of the film forming unit, and a second blocking plate is provided at an end of the rotate-in side. When any one of the film forming units rotates to a position corresponding to the second blocking plate, the second air-flow flowing out of the second air outlet passes through the liquid film on the film forming unit, and applies an inclined up going force to the liquid film, providing the liquid film a trend of flying upward. At the same time, the second blocking plate prevents the first air-flow flowing out of the first air outlet from passing though the liquid film, thus preventing its disturbance with the second air-flow which will break the liquid film. However, since the film forming unit stays at this place for only a very short time, it is unlikely to form bubbles at this point of time. When the film forming unit continuous to rotates to a position corresponding to the first air outlet, flow path of the second air-flow flowing is located below the film forming unit and will not apply any force to the liquid film. At this time, the first air-flow flowing formed by the first air outlet passes through the liquid film on the film forming unit, and applies a force to the liquid film to make it leave the film forming unit and form a bubble, after which the second air-flow applies an inclined up going force to the bubble to make it fly upward. In the above process, no matter the film forming unit rotates to a position corresponding to the second blocking plate, or rotates to a position corresponding to the first air outlet, the force applied on the liquid film on the film forming unit is provided by either one of the first air-flow or the second air-flow, such that the two air flows are prevented from crossing each other and disrupting each other that leads to breaking of liquid film and no forming of bubbles, so as to increase success rate of producing bubbles.

In order to provide the bubbles with more diffusion paths and allow them fly in as many different directions as possible to provide a better effect, the film forming unit is connected with the rotation center by a connecting rod, and a flow splitting portion is provided at the connecting rod. When rotating to the second air outlet, the flow splitting portion splits the second air-flow flowing out of the second air outlet. The second air-flow changes direction after coming into contact with the flow splitting portion. Since the flow splitting portion constantly rotates as the film forming device rotates, the second air-flow contacts different flow splitting portion at different positions, and changes into different directions after contacting the flow splitting portion at different positions, thereby providing the bubbles with more diffusion paths and providing a better viewing effect. Furthermore, to ensure that the second air-flow will flow inclined upward after direction change due to contact with the flow splitting portion, the flow splitting portion has a plane structure of a triangular or sectorial shape, or a three-dimensional structure of a cone or semi-cone or a truncated cone or truncated semi-cone shape.

In order to improve adhesion of liquid film on the film forming unit, a plurality of first protuberances are provided at an inner wall of the film forming unit and in a radial arrangement around an center of the film forming unit, and/or a plurality of second protuberances are provided at upper and lower surfaces of the film forming unit.

To ensure normal operation of the bubble machine, and to ensure that the liquid storage device is capable of continuously providing bubble liquid for the liquid forming device, the liquid storage device has a liquid level at least immersing anyone of the film forming units that rotates to the lowest position.

The present invention provides the following advantages over the prior art:

1. The chamber is provided with a second air outlet, which forms a second air-flow that will provide bubbles just formed by the film forming device with an up going force to make the bubbles fly upward, such that the bubbles can stay in the air for a longer time, increasing remaining time of the bubbles.

2. Two sides of the first air outlet are defined respectively as a rotate-in side and a rotate-out side according to rotation direction of the film forming unit, and a second blocking plate is provided at an end of the rotate-in side. No matter the film forming unit rotates to a position corresponding to the second blocking plate, or rotates to a position corresponding to the first air outlet, the force applied on the liquid film on the film forming unit is provided by either one of the first air-flow or the second air-flow, such that the two air flows are prevented from crossing each other and disrupting each other that leads to breaking of liquid film and no forming of bubbles, so as to increase success rate of producing bubbles.

3. A flow splitting portion located at the path of the second air-flow is provided at the connecting rod connecting the film forming device with the rotation center, providing the bubbles with more diffusion paths and providing a better viewing effect.

BRIEF DESCRIPTION TO THE DRAWINGS

Figure 1:
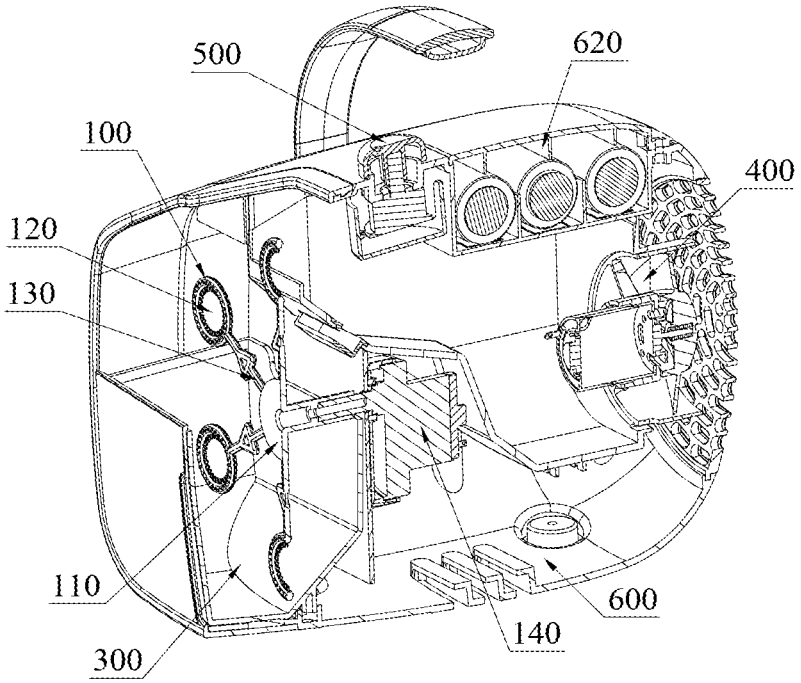
FIG. 1 shows a first schematic view of the inner structure of a bubble machine according to the present invention.

LIST OF REFERENCE NUMBERS film forming device 100
rotation center 110
film forming unit 120
first protuberance 121
second protuberance 122
connecting rod 130
flow splitting portion 131
motor 140
chamber 200
air inlet 210
first air outlet 220
second air outlet 230
blowing surface 240
first inclining surface 251
second inclining surface 252
inclining blowing passage 253
first blocking plate 260
second blocking plate 270
liquid storage device 300
blowing device 400
controlling device 500
housing 600
level observing hole 610
battery mounting slot 620
wire insertion hole 630
handle 640.

DETAILED DESCRIPTION OF THE INVENTION

The present invention will be described in conjugation with embodiments and figures. It is to be understood that the figures are provided merely for illustrative description, but not for limitation to the present invention. To better describe the invention, some parts is omitted, enlarged, or reduced in size in the figures, and do not represent actual size of the product. It is understandable to a skilled person in the art that some well-known structures and their descriptions may be omitted. It is also to be understood that the position relationship shown in the figures are provided merely for illustrative description, but not for limitation to the present invention.

Figure 2:
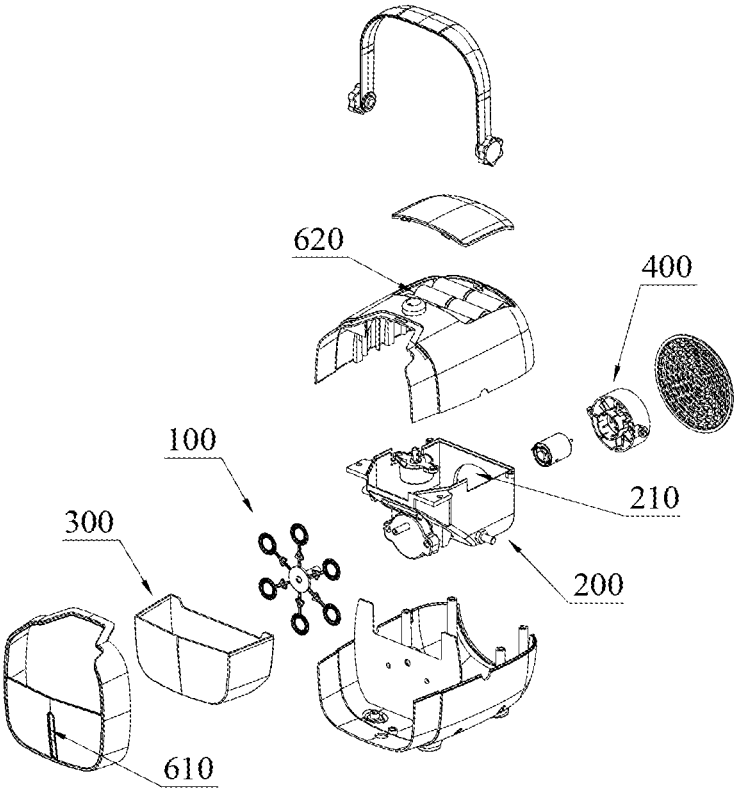
FIG. 2 shows an exploded view of a bubble machine according to the present invention.

As shown in FIGS. 1 and 2, a bubble machine is provided, comprising a housing 600; a liquid storage device 300 provided at front of the housing 600 for containing a bubble liquid; a chamber 200 provided at rear of the liquid storage device 300, comprising an air inlet 210 and a first air outlet 220; a film forming device 100 provided above the liquid storage device 300; a blowing device 400 provided in the housing 600 for providing air flow from the air inlet 210 to the first air outlet 220; and a control device 500 provided at top of the housing 600 for controlling the film forming device 100 and the blowing device 400. The film forming device 100 comprises a rotation center 110, a film forming unit 120 connected with the rotation center 110, and a motor 140 for driving rotation of the film forming unit 120 about the rotation center 110, wherein the motor 140 drives the film forming unit 120 to rotate to successively pass the bubble liquid in the liquid storage device 300 and the first air outlet 220.

Figure 3:
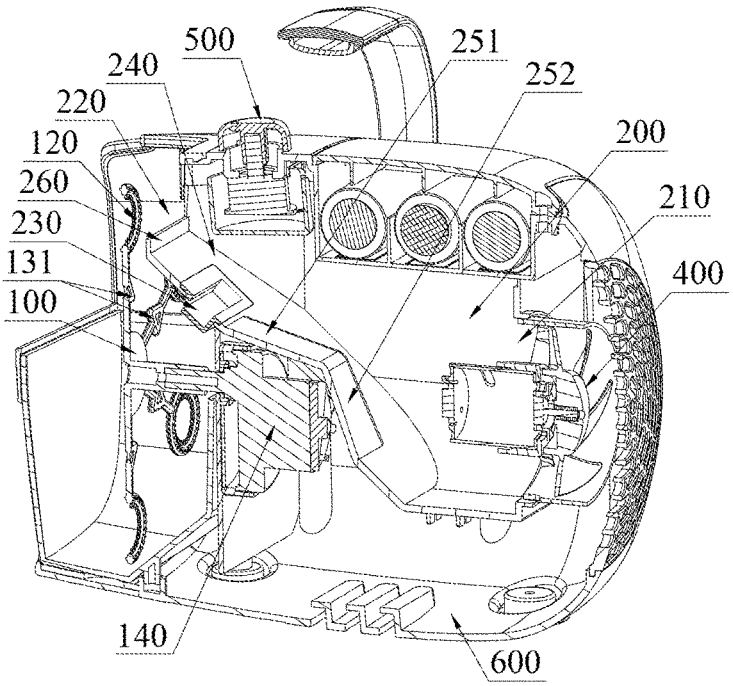
FIG. 3 shows a second schematic view of the inner structure of a bubble machine according to the present invention.

As shown in FIG. 3, in order to allow liquid film on the film forming unit 120 successfully form bubbles with the aid of air flow, a first air-flow out from the first air outlet 220 is required to be substantially perpendicular to the surface of the film forming unit 120, otherwise it is easy to break the liquid film and hard to form bubbles, reducing bubble producing rate. However, this also makes the first air-flow only capable of pushing formed bubbles far away, but not pushing bubbles to fly upward. In view of this, a second air outlet 230 is provided between the first air outlet 220 and the rotation center 110, the second air outlet 230 is inclining upward and connected with the chamber 200. A second air-flow out from the second air outlet 230 will flow inclining upward along the second air outlet 230, and provide bubbles just formed by the film forming device 100 with an up going force to make the bubbles fly upward, such that the bubbles can stay in the air for a longer time, increasing remaining time of the bubbles.

As shown in FIG. 3, in order to provide a bubble machine with a compact structure, the blowing device 400 is generally in a coaxial arrangement with the film forming device 100. In order to make air-flow in the lower portion go upward, an inclining blowing surface 240 is formed at a front end of the chamber 200, the first air outlet 220 is formed between an upper edge of the blowing surface 240 and the housing 600, and the second air outlet 230 is formed below the upper edge of the blowing surface 240. After coming into contact with the blowing surface 240, the air flow produced by the blowing device 400 will flow upward along the blowing surface 240 under pushing of subsequent air flow, and finally flow out of the second air outlet 230 or the first air outlet 220.

As shown in FIG. 3, since the blowing surface 240 is in an inclined arrangement, in order to prevent part of the air flow that is going upward along the blowing surface 240 directly flowing out of the first air outlet 220 in an inclined upward direction, thereby forming disturbance to the first air-flow and increasing difficulty of forming bubbles, the blowing surface 240 is provided with a first blocking plate 260 at the upper edge at the first air outlet 220. After coming into contact with the first blocking plate 260, the part of air flow that is going upward along the blowing surface 240 will flow upward along the first blocking plate 260 under pushing of other horizontal air flow, whose flow-rate will be greatly decreased after changing direction due to contact with the wall, thereby reducing influence on direction of the first air-flow and thus reducing influence on bubble producing.

Figure 4:
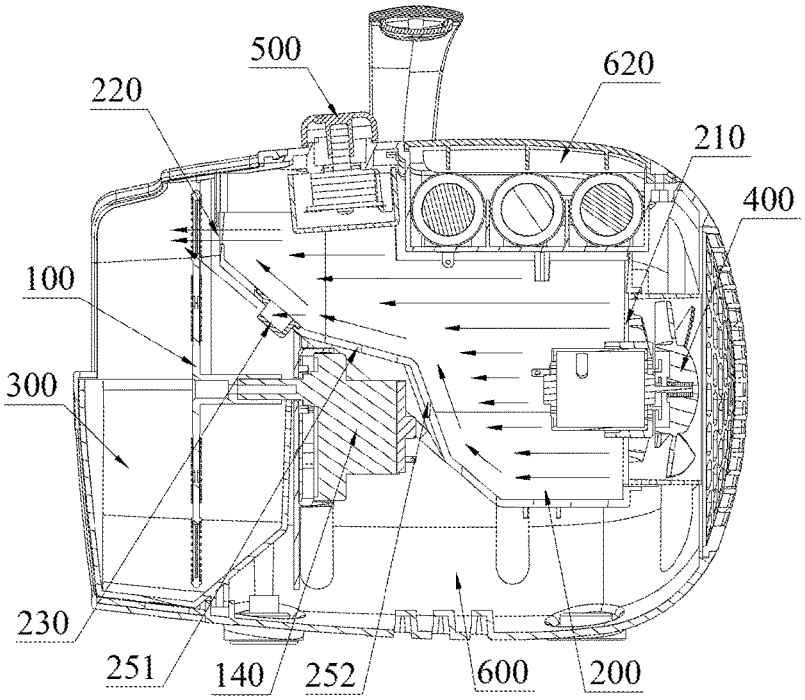
FIG. 4 shows a schematic view of directions of air flow in a bubble machine according to the present invention.

As shown in FIG. 4, the blowing surface 240 is provided with a first inclining surface 251 and a second inclining surface 252 below the second air outlet 230, and a obtuse angle is formed by the first inclining surface 251 and the second inclining surface 252. On one hand, the first inclining surface 251 and the second inclining surface 252 provide guidance to direction of the air flow. The air flow formed by the blowing device 400 flows parallel to the horizontal plane, and then changes direction after coming into contact with the first inclining surface 251 or the second inclining surface 252, and at the same time it is pushed by other horizontal air flow constantly coming from the blowing device 400. This makes the air flow hit the wall and then climb up along the first inclining surface 251 or the second inclining surface 252 toward the second air outlet 230, and finally most of the climbing up air flow flows out of the second air outlet 230 in a predesigned angle, thus forming the second air-flow to push bubbles to fly upward. On the other hand, switching between forming liquid film and forming bubbles of the film forming unit 120 will make its surrounding environment filled with gaseous water molecules. The motor 140 that drives rotation of the film forming unit 120 is located closest to where gaseous water molecules are formed, and therefore is easiest to fail due to moisture. The first inclining surface 251 and the second inclining surface 252 allow more enclosed space formed between the chamber 200 and the housing 600 for receiving the motor 140 that drives rotation of the film forming unit 120. Even all the above circuit elements can be received in the enclosed space formed between the chamber 200 and the housing 600. This ensures these elements always in a dry state, increasing life of the bubble machine.

Figure 5:
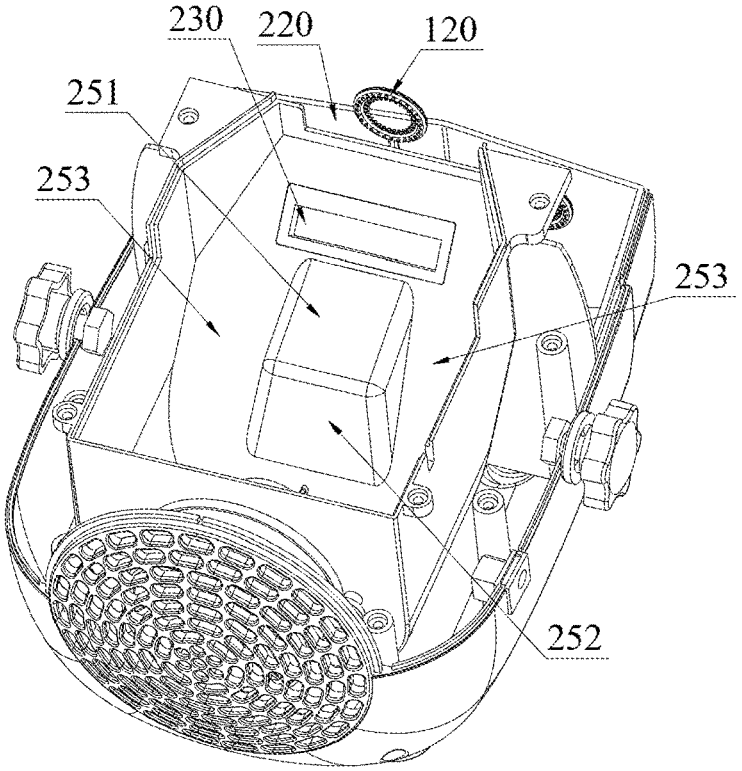
FIG. 5 shows a schematic view of a blowing surface in a bubble machine according to the present invention.

As shown in FIG. 5, in order to distribute more air flow formed by the blowing device 400 to the first air outlet 220 to form bubbles, the first inclining surface 251 and the second inclining surface 252 are both located in middle of the blowing surface 240, two side of which forms an inclining blowing passage 253. Air flow at two sides of the chamber 200 climbs up along the inclining blowing passage 253, and due to inertia effect, most of the air flow will cross the second air outlet 230 and flow out of the first air outlet 220, allowing more air flow formed by the blowing device 400 be used for forming bubbles.

In order to reduce the flow caught by the second air outlet 230 in the chamber 200, a transverse size of the second air outlet 230 is smaller than a transverse size of the first air outlet 220, so as to ensure that a considerable proportion of the air flow formed by the blowing device 400 is used for forming bubbles.

Figure 6:
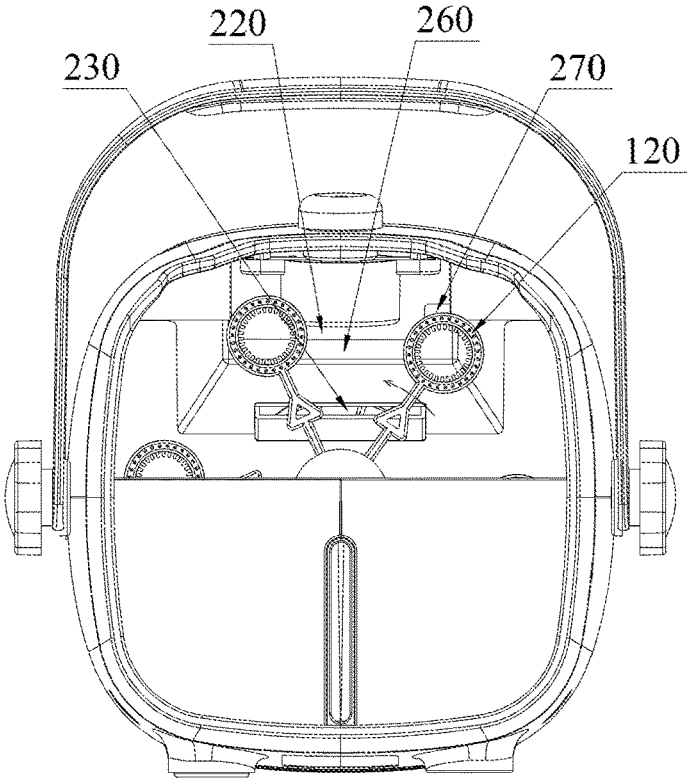
FIG. 6 shows a first schematic view of the rotation of a film forming unit according to the present invention.
Figure 7:
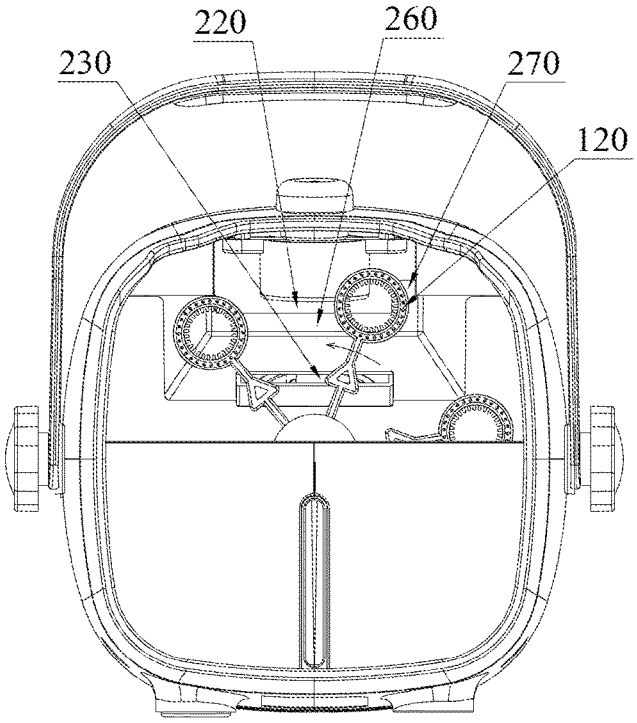
FIG. 7 shows a second schematic view of the rotation of a film forming unit according to the present invention.

As shown in FIGS. 6 and 7, two sides of the first air outlet 220 are defined according to rotation direction of the film forming unit 120 to respectively be a rotate-in side and a rotate-out side, and a second blocking plate 270 is provided at an end of the rotate-in side. As shown in FIG. 6, when any one of the film forming units 120 rotates to a position corresponding to the second blocking plate 270, the second air-flow flowing out of the second air outlet 230 passes through the liquid film on the film forming unit 120, and applies an inclined up going force to the liquid film, providing the liquid film a trend of flying upward. At the same time, the second blocking plate 270 prevents the first air-flow flowing out of the first air outlet 220 from passing though the liquid film, thus preventing its disturbance with the second air-flow which will break the liquid film. However, since the film forming unit 120 stays at this place for only a very short time, it is unlikely to form bubbles at this point of time. As shown in FIG. 7, when the film forming unit 120 continuous to rotates to a position corresponding to the first air outlet 220, flow path of the second air-flow flowing is located below the film forming unit 120 and will not apply any force to the liquid film. At this time, the first air-flow flowing formed by the first air outlet 220 passes through the liquid film on the film forming unit 120, and applies a force to the liquid film to make it leave the film forming unit 120 and form a bubble, after which the second air-flow applies an inclined up going force to the bubble to make it fly upward. In the above process, no matter the film forming unit 120 rotates to a position corresponding to the second blocking plate 270, or rotates to a position corresponding to the first air outlet 220, the force applied on the liquid film on the film forming unit 120 is provided by either one of the first air-flow or the second air-flow, such that the two air flows are prevented from crossing each other and disrupting each other that leads to breaking of liquid film and no forming of bubbles, so as to increase success rate of producing bubbles.

Figure 8:
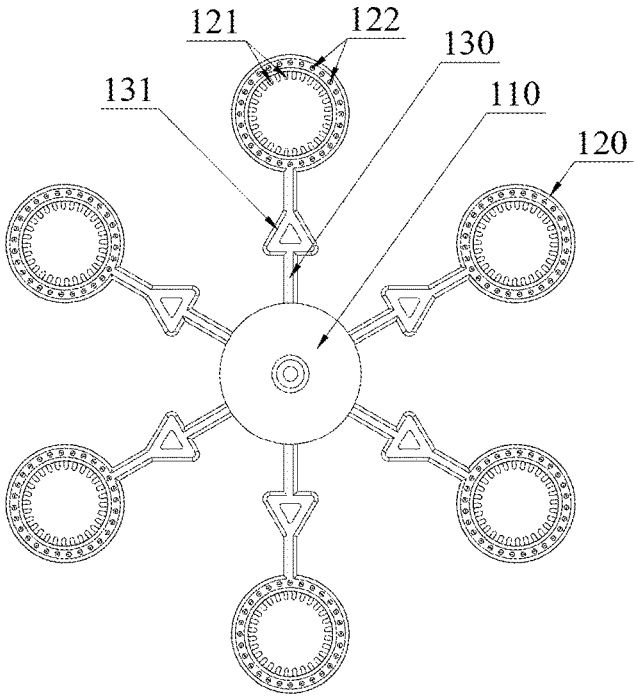
FIG. 8 shows a schematic view of the structure of a film forming device according to the present invention.

As shown in FIG. 8, in order to provide the bubbles with more diffusion paths and allow them fly in as many different directions as possible to provide a better effect, the film forming unit 120 is connected with the rotation center 110 by a connecting rod 130, and a flow splitting portion 131 is provided at the connecting rod 130. When rotating to the second air outlet 230, the flow splitting portion 131 splits the second air-flow flowing out of the second air outlet 230. The second air-flow changes direction after coming into contact with the flow splitting portion 131. Since the flow splitting portion 131 constantly rotates as the film forming device 100 rotates, the second air-flow contacts different flow splitting portion 131 at different positions, and changes into different directions after contacting the flow splitting portion 131 at different positions, thereby providing the bubbles with more diffusion paths and providing a better viewing effect. Furthermore, to ensure that the second air-flow will flow inclined upward after direction change due to contact with the flow splitting portion 131, the flow splitting portion 131 has a plane structure of a triangular or sectorial shape, or a three-dimensional structure of a cone or semi-cone or a truncated cone or truncated semi-cone shape.

As shown in FIG. 8, in order to improve adhesion of liquid film on the film forming unit 120, a plurality of first protuberances 121 are provided at an inner wall of the film forming unit 120 and in a radial arrangement around an center of the film forming unit 120, and/or a plurality of second protuberances 122 are provided at upper and lower surfaces of the film forming unit 120.

To ensure normal operation of the bubble machine, and to ensure that the liquid storage device 300 is capable of continuously providing bubble liquid for the liquid forming device 100, the liquid storage device 300 has a liquid level at least immersing anyone of the film forming units 120 that rotates to the lowest position. The housing 600 is provided with a level observing hole 610 at its front surface, to facilitate a user to observe liquid level in the liquid storage device 300 and fill up bubble liquid in time. In addition, to facilitate observation of liquid level, front of the housing 600 can all be made of transparent materials.

Figure 9:
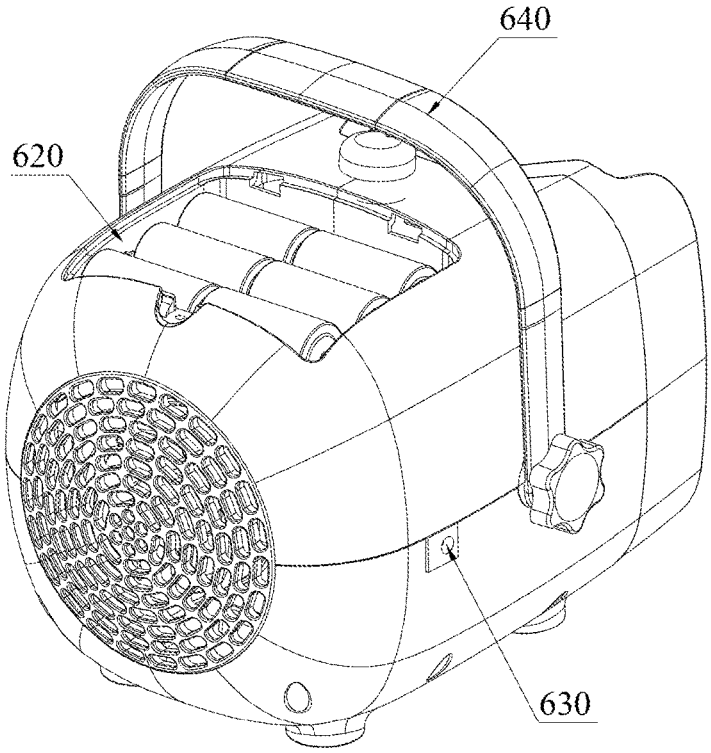
FIG. 9 shows a schematic view of the overall structure of a bubble machine according to the present invention.

As shown in FIG. 9, the housing 600 is provided with a battery mounting slot 620 at its top for mounting batteries. The housing 600 is provide with a wire insertion hole 630 at its sides for connecting with an external power supply. A user can choose different power supply according to actual needs.

As shown in FIG. 9, the housing 600 is connected with a handle 640 at its two sides to facilitate a user to lift the bubble machine and move it to where it is needed.

Obviously, the above examples are merely examples provided for clear illustration of the present invention, but not limitations to embodiments of the present invention. Other variations or modifications can be made by a skilled person in the art based on the above description. It is neither necessary nor possible to exhaustively make examples for all embodiments. Modifications, equivalent substitutions and improvements made within the spirit and principle of the present invention shall all fall in the scope of the present invention defined by the claims.

The invention claimed is:

1. A bubble machine, comprising a housing, a liquid storage device provided at front of the housing for containing a bubble liquid, a chamber provided at rear of the liquid storage device, comprising an air inlet and a first air outlet, a film forming device provided above the liquid storage device, comprising a rotation center, a film forming unit connected with the rotation center by a connecting rod having a flow splitting portion provided thereon, and a motor for driving rotation of the film forming unit about the rotation center, wherein the motor drives the film forming unit to rotate to successively pass the bubble liquid in the liquid storage device and the first air outlet, and the flow splitting portion has a plane structure of a triangular or sectorial shape, or a three-dimensional structure of a cone or semi-cone or a truncated cone or truncated semi-cone shape, a second air outlet provided below the first air outlet, wherein the second air outlet is inclining upward, a blowing device provided in the housing for providing air flow from the air inlet to the first air outlet and the second air outlet, and a control device provided in the housing for controlling the film forming device and the blowing device.

2. The bubble machine according to claim 1, wherein an inclining blowing surface is formed at a front end of the chamber, the first air outlet is formed between an upper edge of the blowing surface and the housing, and the second air outlet is formed below the upper edge of the blowing surface.

3. The bubble machine according to claim 2, wherein the blowing surface is provided with a first blocking plate at the upper edge at the first air outlet.

4. The bubble machine according to claim 2, wherein the blowing surface is provided with a first inclining surface and a second inclining surface below the second air outlet, and an obtuse angle is formed by the first inclining surface and the second inclining surface.

5. The bubble machine according to claim 4, wherein the first inclining surface and the second inclining surface are located in a middle of the blowing surface, an inclining blowing passage is formed on a right side and a left side of the first inclining surface and the second inclining surface.

6. The bubble machine according to claim 1, wherein a transverse size of the second air outlet is smaller than a transverse size of the first air outlet.

7. The bubble machine according to claim 1, wherein two sides of the first air outlet are defined respectively as a rotate-in side and a rotate-out side according to rotation direction of the film forming unit, and a blocking plate is provided at an end of the rotate-in side.

8. The bubble machine according to claim 1, wherein a plurality of first protuberances are provided at an inner wall of the film forming unit and in a radial arrangement around a center of the film forming unit, and/or a plurality of second protuberances are provided at upper and lower surfaces of the film forming unit.

* * * * *